US011245174B2

(12) United States Patent
Hirota et al.

(10) Patent No.: US 11,245,174 B2
(45) Date of Patent: Feb. 8, 2022

(54) ELECTRONIC APPARATUS

(71) Applicant: Dynabook Inc., Tokyo (JP)

(72) Inventors: Toshiyuki Hirota, Hino Tokyo (JP); Hikaru Hirata, Tachikawa Tokyo (JP); Tomofumi Miyamoto, Hamura Tokyo (JP); Shingo Koide, Tachikawa Tokyo (JP)

(73) Assignee: DYNABOOK INC., Tokyo (JP)

( * ) Notice: Subject to any disclaimer, the term of this patent is extended or adjusted under 35 U.S.C. 154(b) by 107 days.

(21) Appl. No.: 16/450,721

(22) Filed: Jun. 24, 2019

(65) Prior Publication Data

US 2020/0235461 A1 Jul. 23, 2020

(30) Foreign Application Priority Data

Jan. 21, 2019 (JP) ..... JP2019-007872

(51) Int. Cl.
*H01Q 1/22* (2006.01)
*H01Q 1/48* (2006.01)

(52) U.S. Cl.
CPC ..... *H01Q 1/2266* (2013.01); *H01Q 1/48* (2013.01)

(58) Field of Classification Search
CPC .... H01Q 1/2258; H01Q 1/2266; H01Q 1/243; H01Q 1/42; H01Q 1/422; H01Q 1/48
See application file for complete search history.

(56) References Cited

U.S. PATENT DOCUMENTS

| | | | | |
|---|---|---|---|---|
| 5,722,055 | A | 2/1998 | Kobayashi et al. | |
| 8,059,039 | B2 * | 11/2011 | Ayala Vazquez .... | H01Q 1/2266 343/702 |
| 8,264,412 | B2 * | 9/2012 | Ayala ..... | H01Q 1/2266 343/702 |
| 8,310,404 | B2 | 11/2012 | Kishimoto et al. | |
| 2006/0077104 | A1 | 4/2006 | Usui et al. | |
| 2008/0055184 | A1 | 3/2008 | Noro et al. | |

FOREIGN PATENT DOCUMENTS

| | | | |
|---|---|---|---|
| JP | 2003-264413 | A | 9/2003 |
| JP | 2006-115089 | A | 4/2006 |
| JP | 2008-61084 | A | 3/2008 |
| JP | 2009-157631 | A | 7/2009 |

* cited by examiner

*Primary Examiner* — Dimary S Lopez Cruz
*Assistant Examiner* — Patrick R Holecek
(74) *Attorney, Agent, or Firm* — Knobbe, Martens, Olson & Bear LLP

(57) ABSTRACT

The housing includes a first base portion and a second base portion which are conductive respectively. The first base portion and the second base portion are disposed in contact. The antenna element is connected to the antenna ground. The antenna ground is formed on the antenna board. The gasket is located between the first base portion and the antenna ground in a height direction of the housing, and is conductive. The fixing member fixes the second base portion and the antenna ground so that the second base portion and the antenna ground are electrically connectable to each other in a state where the gasket is in contact with the first base portion and the antenna ground.

7 Claims, 6 Drawing Sheets

ELECTRONIC APPARATUS

CROSS-REFERENCE TO RELATED APPLICATIONS

This application is based upon and claims the benefit of priority from Japanese Patent Application No. 2019-007872, filed Jan. 21, 2019, the entire contents of which are incorporated herein by reference.

FIELD

Embodiments described herein relate generally to an electronic apparatus.

BACKGROUND

The technique of providing an electronic apparatus with an antenna for communication has been known. For example, the technique of fitting and fixing an antenna feeding member formed of a sheet metal member into a rear case member has been disclosed.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Figure 1:
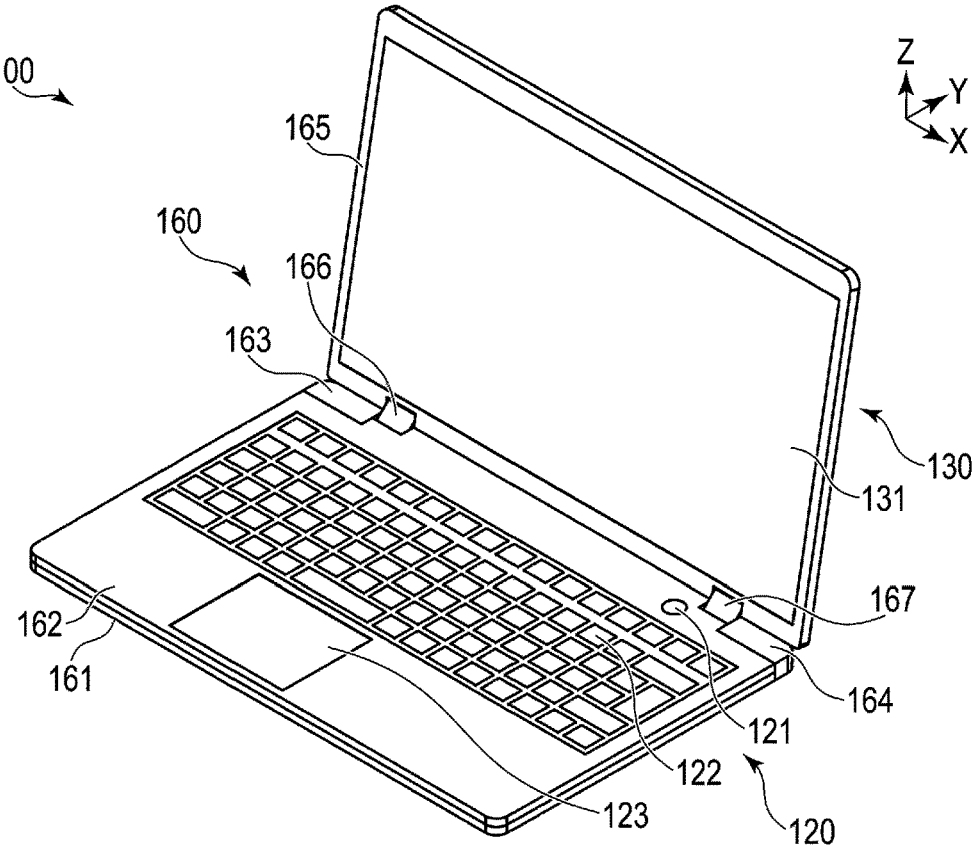
FIG. 1 is a perspective view showing a notebook computer 100 of an embodiment.

Various embodiments will be described hereinafter with reference to the accompanying drawings. The disclosure is merely an example, and the invention is not limited to the matters disclosed in the following embodiments. Modifications which are easily conceivable by a person having ordinary skill in the art are included in the scope of the disclosure as a matter of course. To make the description clearer, in the drawings, the size, the shape, etc., of each portion may be schematically shown with changes to the actual modes. In the drawings, elements corresponding to each other may be given the same reference numbers, and a detailed description thereof may be omitted. In the drawings, the width direction X, the depth direction Y, and the height direction Z of a notebook computer 100 are indicated by arrows.

In general, an electronic apparatus according to an embodiment comprises a housing, an antenna element, an antenna ground, an antenna board, a gasket, and a fixing member. The housing comprises a first base portion and a second base portion which are conductive respectively. The first base portion and the second base portion are disposed in contact with each other. The antenna element is connected to the antenna ground. At least the antenna ground is formed on the antenna board. The gasket is located between the first base portion and the antenna ground in a height direction of the housing, and is conductive. The fixing member fixes the second base portion and the antenna ground so that the second base portion and the antenna ground are electrically connectable to each other in a state where the gasket is in contact with the first base portion and the antenna ground.

The structure of the notebook computer 100 of the embodiment will be described with reference to FIG. 1 to FIG. 9.

The notebook computer 100 (referred to as an electronic apparatus in the claims) comprises an arithmetic unit 110, an input/output unit 120, a display unit 130, a power supply unit 140, a wireless communication unit 150, and a housing unit 160. The arithmetic unit 110, the input/output unit 120, the display unit 130, the power supply unit 140, the wireless communication unit 150, and the housing unit 160 of the notebook computer 100 will be described in order.

Figure 3:
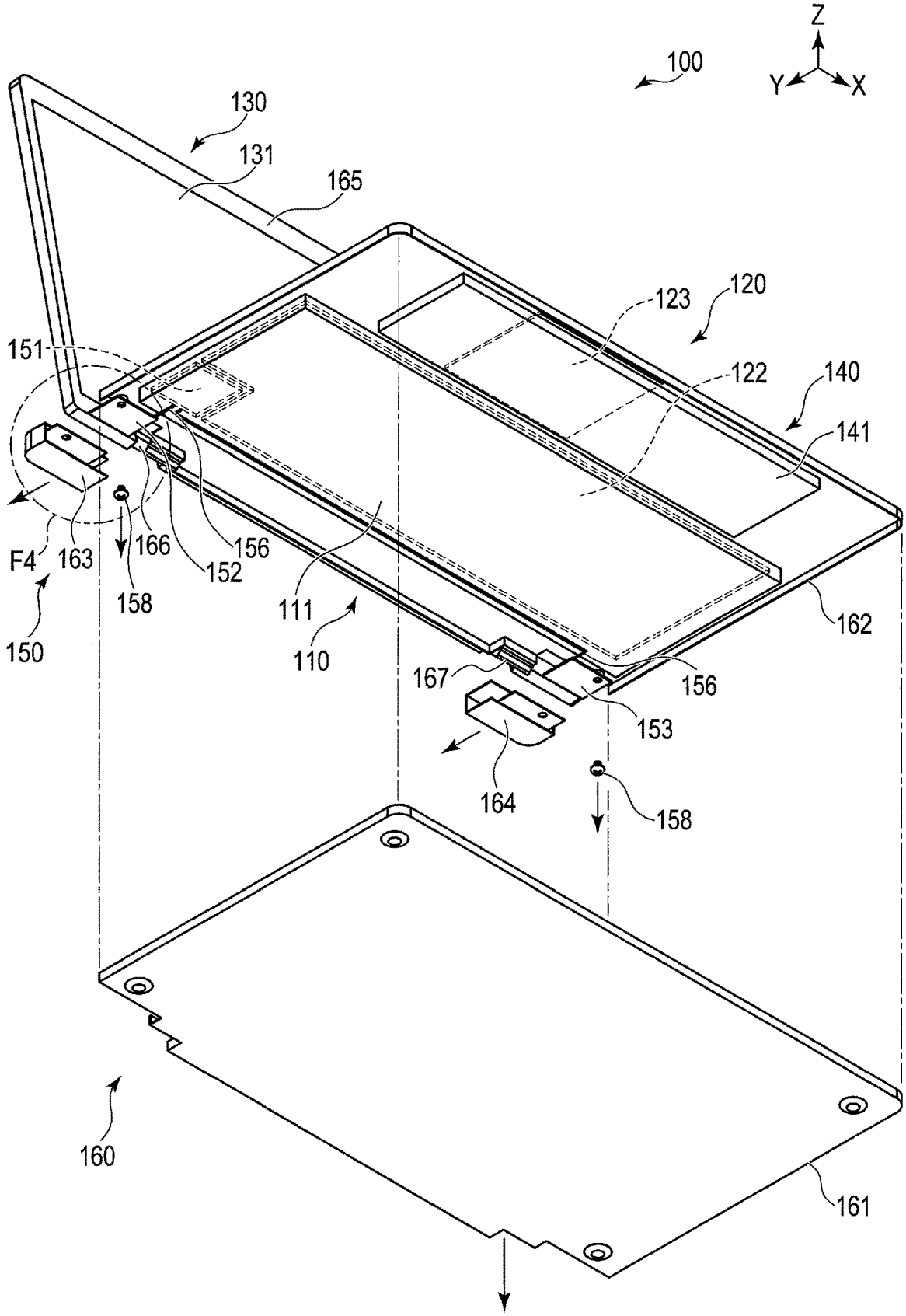
FIG. 3 is a perspective view showing the notebook computer 100 of FIG. 2 with part of its structural elements taken apart.

The arithmetic unit 110 is a unit which performs operations. As shown in FIG. 3, the arithmetic unit 110 comprises a motherboard 111. The motherboard 111 corresponds to a system board. The motherboard 111 is constituted of a board on which a read-only memory (ROM), a central processing unit (CPU), a random access memory (RAM), etc., are mounted, and a cooling fan, etc., which cools the CPU, etc., is installed therein.

The input/output unit 120 is a unit via which a user performs an input/output operation of data. As shown in FIG. 1 and FIG. 3, the input/output unit 120 comprises a power button 121, a keyboard 122, a touchpad 123, and an input/output terminal not shown in the figures. The power button 121 is a switch for booting the notebook computer 100, and is connected to the motherboard 111. The keyboard 122 is constituted of a plurality of mechanical keys, and is connected to the motherboard 111. The touchpad 123 is constituted of a capacitive sensor which detects a change in capacitance made by a fingertip, and is connected to the motherboard 111. The input/output terminal is, for example, constituted of a universal serial bus (USB) terminal.

Figure 2:
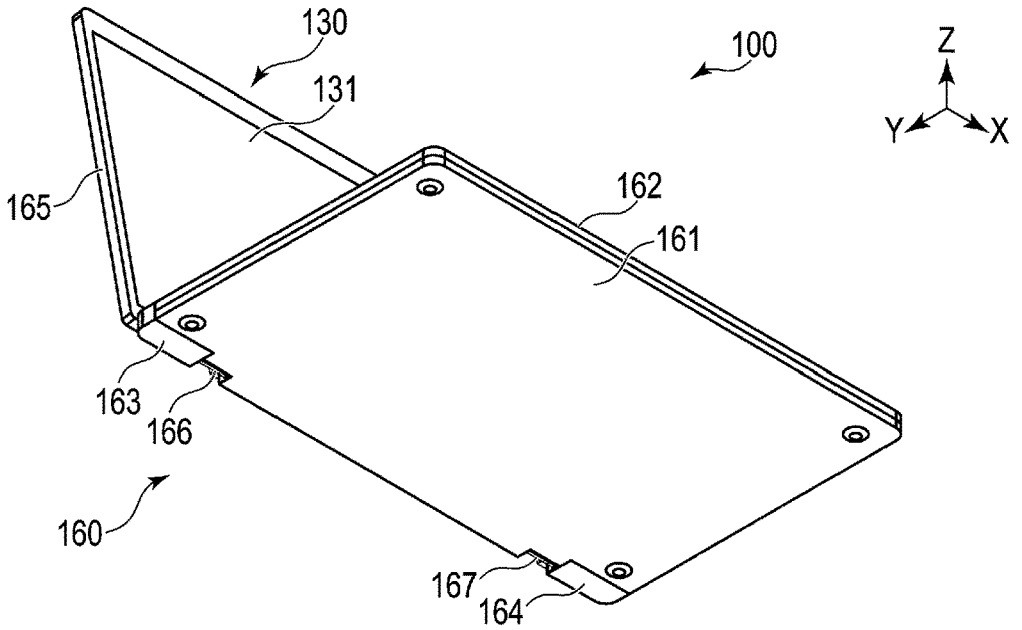
FIG. 2 is a perspective view showing the notebook computer 100 of FIG. 1 from below.

The display unit 130 is a unit which displays information via the arithmetic unit 110. As shown in FIG. 1 to FIG. 3, the display unit 130 comprises an LCD 131. The LCD 131 is a liquid crystal display. The display unit 130 is not limited to a liquid crystal display, and may be constituted of, for example, an organic electroluminescent display or a projector which projects images onto a wall surface.

The power supply unit 140 is a unit which supplies power to the arithmetic unit 110, etc. As shown in FIG. 3, the power supply unit 140 comprises a battery 141. The battery 141 is constituted of a rechargeable lithium-ion secondary battery, and is charged by an external power supply via an AC adaptor.

The wireless communication unit 150 is a unit which wirelessly communicates with an external apparatus via the arithmetic unit 110. As shown in FIG. 3 to FIG. 9, the wireless communication unit 150 comprises a wireless module 151, a first antenna board 152, a second antenna board 153, an antenna element 154, an antenna ground 155, a coaxial cable 156, a gasket 157, and a screw 158.

As shown in FIG. 3, the wireless module 151 is connected to the motherboard 111. The wireless module 151 has a communication function, and comprises an interface (I/F) with the motherboard 111, an antenna connector, etc.

As shown in FIG. 3 to FIG. 9, the first antenna board 152 (referred to as an antenna board in the claims) has insulating properties and has the shape of a plate. In the first antenna board 152, a screw insertion hole 152*a*, into which the screw 158 is inserted, is formed.

As shown in FIG. 3, the second antenna board 153 (referred to as an antenna board in the claims) has the same structure as the first antenna board 152, and is located so as to be symmetrical to the first antenna board 152 in the width direction X. Thus, a screw hole in the second antenna board 153 is formed so as to be symmetrical to the screw insertion hole 152*a* of the first antenna board 152 in the width direction X.

Figure 5:
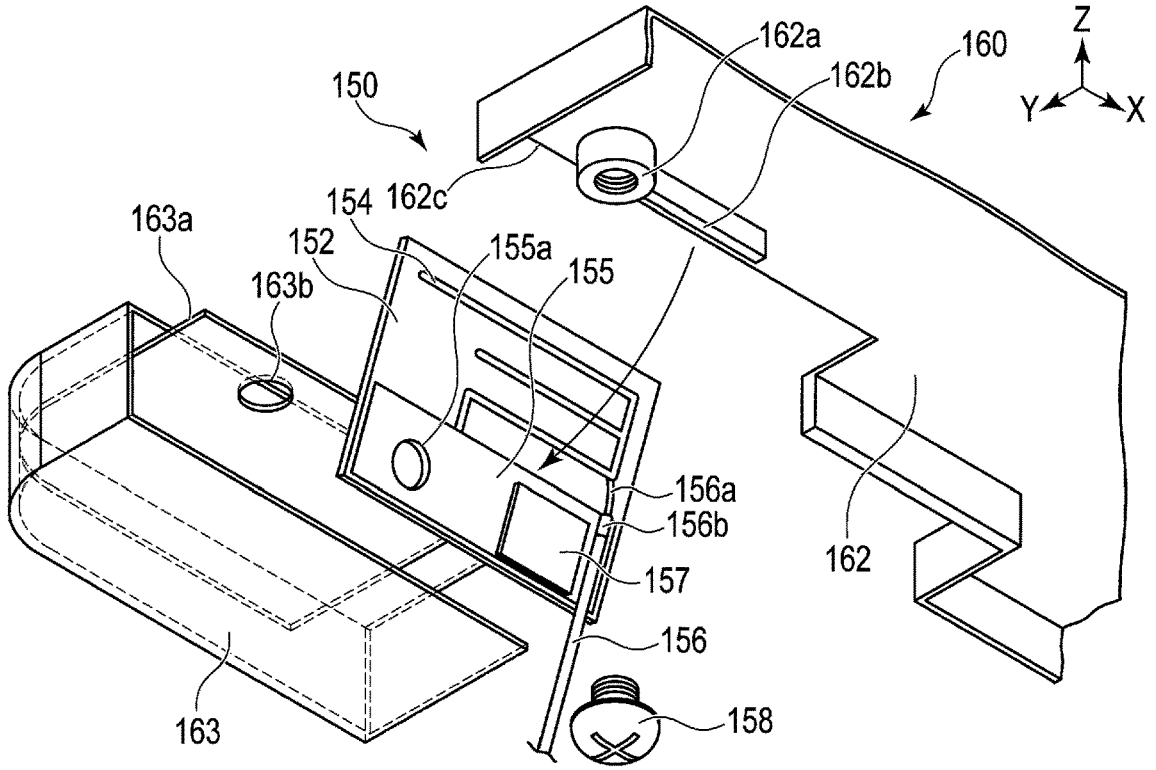
FIG. 5 is a perspective views showing the structural elements shown in FIG. 4 with an antenna board 152 inside out.
Figure 6:
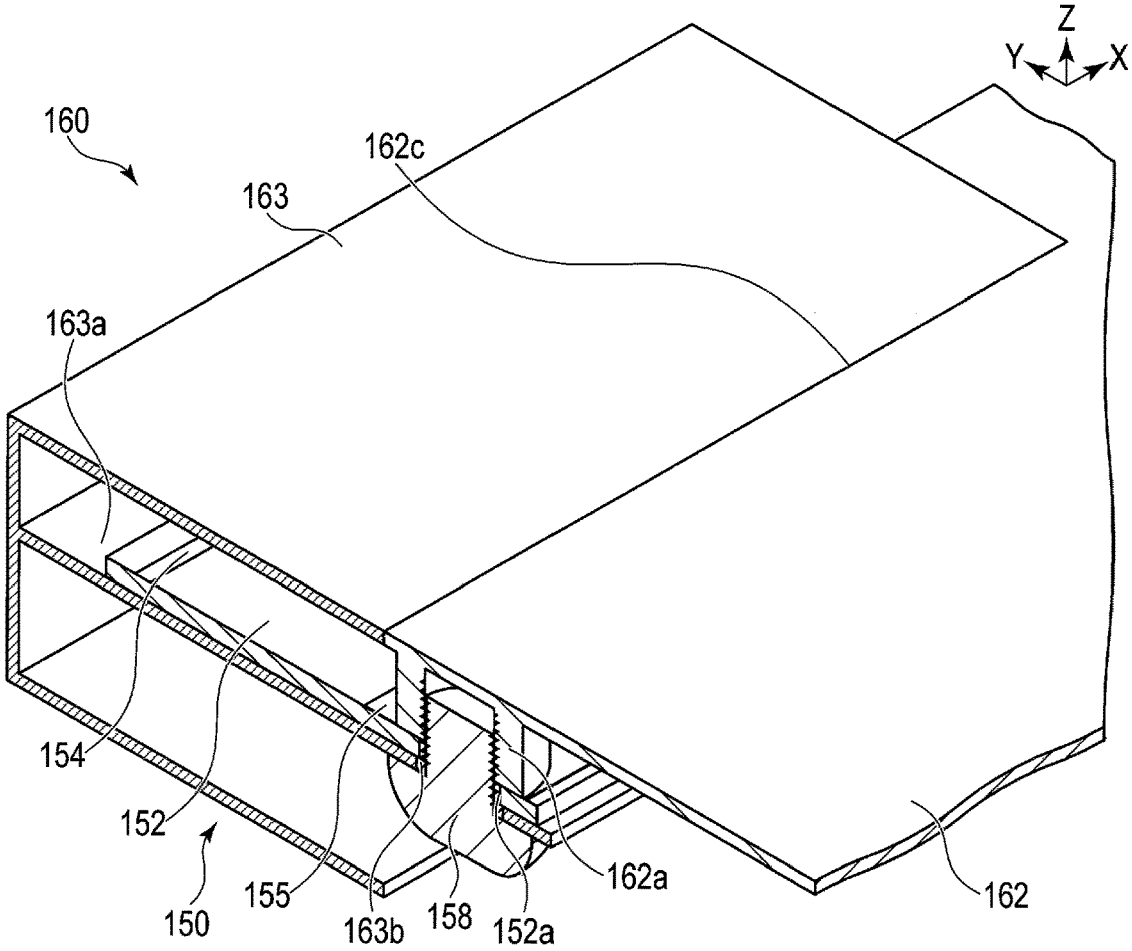
FIG. 6 is a perspective view showing the structural elements of FIG. 4 in an assembled state in a section along a direction F6.
Figure 7:
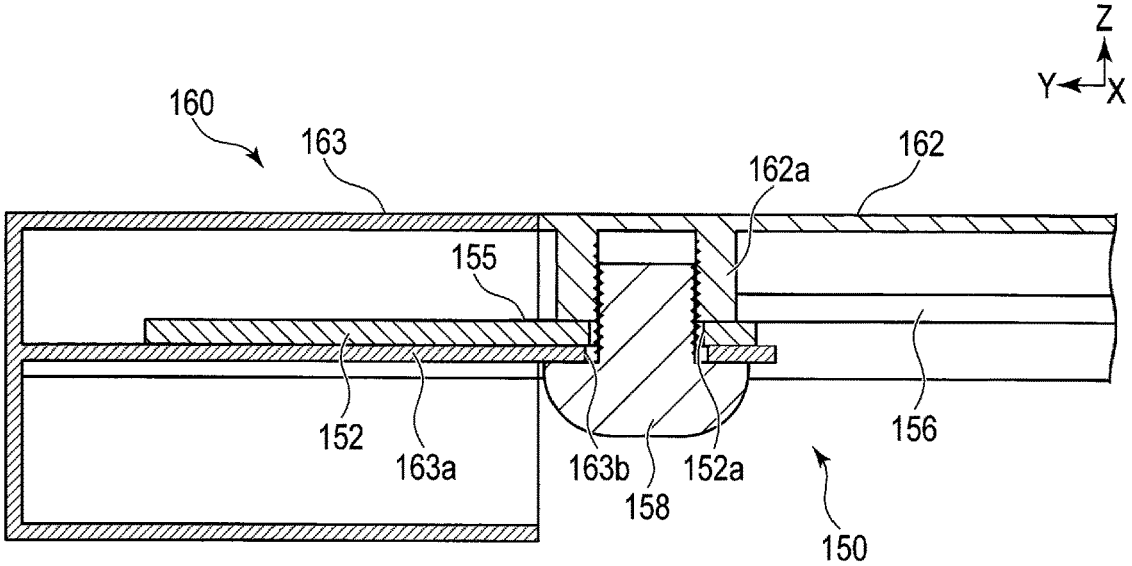
FIG. 7 is a side view showing the structural elements of FIG. 6.
Figure 8:
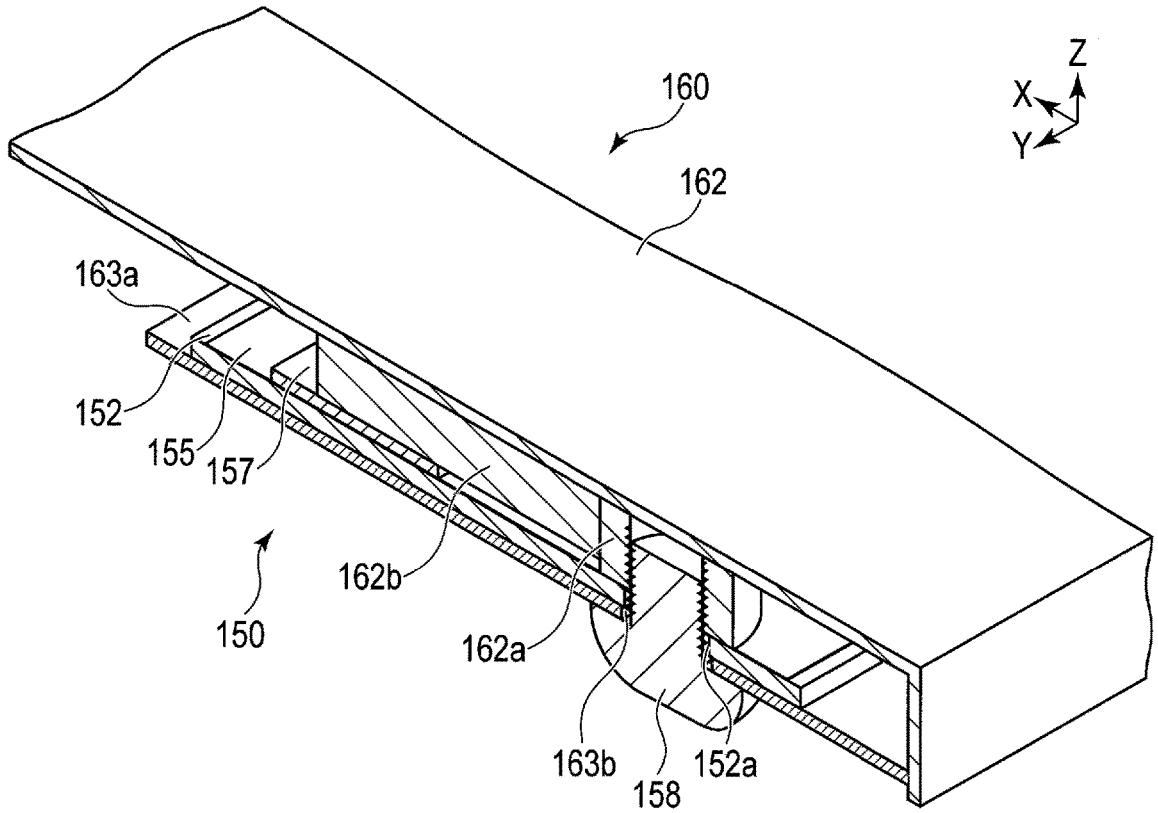
FIG. 8 is a perspective view showing the structural elements of FIG. 4 in an assembled state in a section along a direction F8.

As shown in FIG. 5 and FIG. 6, the antenna element 154 is formed on the first antenna board 152. The resonant frequency of the antenna element 154 is, for example, greater than or equal to 2.4 GHz. The antenna element 154 is also mounted on the second antenna board 153.

As shown in FIG. 5 to FIG. 9, the antenna ground 155 is formed on the first antenna board 152 so as to be adjacent to the antenna element 154. As shown in FIG. 5, a screw insertion hole 155*a*, into which the screw 158 is inserted, is formed in the antenna ground 155 at a position corresponding to that of the screw insertion hole 152*a* of the first antenna board 152. The antenna ground 155 is also mounted on the second antenna board 153.

As shown in FIG. 3, FIG. 4, FIG. 5, FIG. 7, and FIG. 9, the coaxial cable 156 (referred to as a communication cable in the claims) is attached to the antenna element 154 and the antenna ground 155. As shown in FIG. 5, an internal conductor 156*a* of the coaxial cable 156 is joined to the antenna element 154, and an external conductor 156*b* of the coaxial cable 156 is joined to the antenna ground 155. The coaxial cable 156 is connected to the wireless module 151. The coaxial cable 156 is also mounted on the second antenna board 153.

As shown in FIG. 4, FIG. 5, FIG. 8, and FIG. 9, the gasket 157 is mounted on the antenna ground 155. The gasket 157 is conductive and elastic, and has the shape of a plate. The gasket 157 contracts when it is pressed, and comes into close contact with upper and lower members that are adjacent to the gasket 157 in the height direction Z (the antenna ground 155 and a rib 162*b* of a top cover 162 of the housing unit 160, which will be described later). The gasket 157 electrically connects the antenna ground 155 to the top cover 162. As shown in FIG. 5, the gasket 157 exists between the screw insertion hole 155*a* of the antenna ground 155 and a portion where the external conductor 156*b* of the coaxial cable 156 is joined to the antenna ground 155 by soldering. The distance between the screw insertion hole 155*a* of the antenna ground 155 and the portion where the external conductor 156*b* of the coaxial cable 156 is joined to the antenna ground 155 by soldering is longer than the distance between the gasket 157 and the portion where the external conductor 156*b* of the coaxial cable 156 is joined to the antenna ground 155 by soldering. The gasket 157 is also mounted on the antenna ground of the second antenna board 153.

As shown in FIG. 3 to FIG. 9, the screw 158 (referred to as a fixing member in the claims) fixes the first antenna board 152 to the housing unit 160 and electrically connects the antenna ground 155 to the housing unit 160. The first antenna board 152 is screwed by the screw 158 in the state of being interposed between a support portion 163*a* of a first antenna cover 163 and a screw boss 162*a* of the top cover 162. On the other hand, the gasket 157 electrically connects the antenna ground 155 and the top cover 162 in the state of being interposed between the support portion 163*a* of the first antenna cover 163 and the rib 162*b* of the top cover 162 via the first antenna board 152 and the antenna ground 155. With the screw 158, the second antenna board 153 is also fixed to the housing unit 160, and the antenna ground is electrically connected to the housing unit 160.

The housing unit 160 is a unit which holds the arithmetic unit 110, the input/output unit 120, the display unit 130, the power supply unit 140, and the wireless communication unit 150. As shown in FIG. 1 to FIG. 9, the housing unit 160 comprises a bottom cover 161, the top cover 162, the first antenna cover 163, a second antenna cover 164, an LCD cover 165, a first hinge 166, and a second hinge 167.

As shown in FIG. 1 to FIG. 3, the bottom cover 161 holds the motherboard 111 of the arithmetic unit 110, and the battery 141 of the power supply unit 140, etc., from below. The bottom cover 161 corresponds to the back surface of the notebook computer 100, which is placed on a desk when used.

As shown in FIG. 1 to FIG. 3, the top cover 162 (referred to as a housing in the claims) holds the power button 121 of the input/output unit 120, the keyboard 122, and the touchpad 123 from above. The top cover 162 corresponds to the front surface of the notebook computer 100, which is placed on the desk when used.

In the top cover 162, the screw boss 162*a* (referred to as a second base portion in the claims) is formed on both sides in the width direction X of an outer edge 162*c* adjacent to the LCD cover 165 as shown in FIG. 4 to FIG. 9. The screw boss 162*a* has a cylindrical shape projecting downward, and comprises a screw hole in its center.

In the top cover 162, the rib 162*b* (referred to as a first base portion in the claims) is formed so as to be disposed in the state of being in contact with the screw boss 162*a* inside in the width direction X as shown in FIG. 4, FIG. 5, FIG. 8, and FIG. 9. The rib 162*b* has a rectangular shape projecting downward, and extends in the width direction X. The downward total length of the rib 162*b* is short as compared to that of the screw boss 162*a*. In other words, the screw boss 162*a* projects from a surface of the top cover 162, closer to a surface of the antenna ground 155 than the rib 162*b* in the height direction. The top cover 162, including the screw boss 162*a* and the rib 162*b*, is conductive.

As shown in FIG. 1 and FIG. 2, the first antenna cover 163 (referred to as a cover in the claims) covers the structural elements of the wireless communication unit 150 in a state where the bottom cover 161 and the top cover 162 are combined together. The first antenna cover 163 is made of plastics, etc., which transmit radio waves, in other words, which radiate radio waves.

Figure 4:
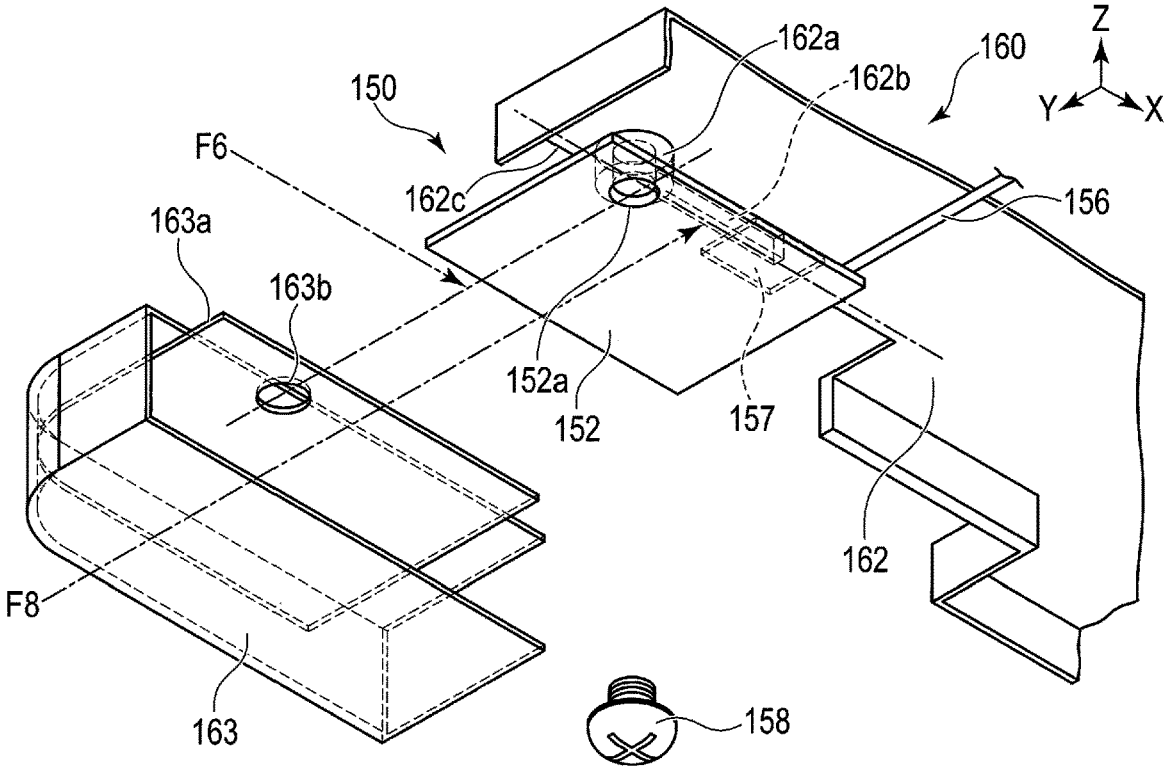
FIG. 4 is a perspective view showing part of the structural elements in an area F4 of the notebook computer 100 of FIG. 3.

As shown in FIG. 4 to FIG. 9, the support portion 163*a*, which extends horizontally (in the width direction X and the depth direction Y), is formed inside the first antenna cover 163. The support portion 163*a* supports the first antenna board 152. As shown in FIG. 4, etc., a screw insertion hole 163*b* is formed in the support portion 163*a* at a portion projecting toward the first antenna board 152. The position of the screw insertion hole 163*b* formed in the support portion 163*a* corresponds to that of the screw insertion hole 152*a* formed in the first antenna board 152. The first antenna cover 163 supports the first antenna board 152, and is attached to the top cover 162.

As shown in FIG. 1 to FIG. 3, the second antenna cover 164 (referred to as a cover in the claims) has the same structure as the first antenna cover 163, and is symmetrical to the first antenna cover 163 in the width direction X.

As shown in FIG. 1 to FIG. 3, the LCD cover 165 holds the LCD 131 of the display unit 130. The LCD cover 165 exposes the surface of the LCD 131 so that the LCD 131 and the top cover 162 face each other in a state where the notebook computer 100 is closed.

As shown in FIG. 1 to FIG. 3, the bottom cover 161 and the top cover 162, and the LCD cover 165 are rotatably coupled together by the first hinge 166. The top cover 162 and the LCD cover 165 are brought away from each other or close to each other via the first hinge 166, and the notebook computer 100 is thereby opened or closed.

As shown in FIG. 1 to FIG. 3, the second hinge 167 has the same structure as the first hinge 166, and is symmetrical to the first hinge 166 in the width direction X. The second hinge 167 couples the bottom cover 161 and the top cover 162, and the LCD cover 165 together with the first hinge 166.

Next, the structure of the notebook computer 100 of a modified example 1 of the embodiment will be described with reference to FIG. 10.

In the modified example 1 of the embodiment, only different structures from those of the above-described embodiment will be described. The structure of a first antenna cover 263 of a housing unit 260 shown in FIG. 10 corresponds to that of the first antenna cover 163 shown in FIG. 6, except that the support portion 163*a* is removed therefrom. In other words, the first antenna cover 263 shown in FIG. 10 is obtained by simplifying the first antenna cover 163 shown in FIG. 6. In the case of the structure shown in FIG. 10, the first antenna board 152 is not supported by the first antenna cover 263, and is screwed to the screw boss 162*a* of the top cover 162.

Next, the structure of the notebook computer 100 of a modified example 2 of the embodiment will be described with reference to FIG. 11.

In the modified example 2 of the embodiment, only different structures from those of the above-described embodiment will be described. A top cover 362 of a housing unit 360 shown in FIG. 11 is obtained by removing the rib 162*b* from the top cover 162 shown in FIG. 9 and replacing the screw boss 162*a* with a pin boss 362*c* whose total length in the height direction Z is relatively short. A support portion 363*a* of a first antenna cover 363 and the top cover 362 are pinned by a pin 358 (referred to as a fixing member in the claims) of a wireless communication unit 350 in a state where the first antenna board 152 and the antenna ground 155 are interposed therebetween. The gasket 157 is electrically connected to the antenna ground 155 and the top cover 362 in the state of being in close contact with the antenna ground 155 and the top cover 362.

The advantages of the notebook computer 100 of the embodiment will be described with reference to FIG. 1 to FIG. 11.

According to the embodiment, the screw boss 162*a* and the antenna ground 155 are fixed by the screw 158 so that the screw boss 162*a* and the antenna ground 155 are electrically connectable to each other in a state where the gasket 157 is in contact with the rib 162*b* and the antenna ground 155. By virtue of this structure, the screw boss 162*a* and the antenna ground 155 are electrically connected to each other by the screw 158, and moreover, the rib 162*b* and the antenna ground 155 are electrically connected to each other by the gasket 157. As a result, the high-frequency connection between the top cover 162 and the antenna ground 155 is thereby strengthened, and stable antenna performance can be secured. In this manner, the notebook computer 100 can achieve the antenna performance that shows little manufacturing variation by virtue of the above-described simple structure.

Figure 9:
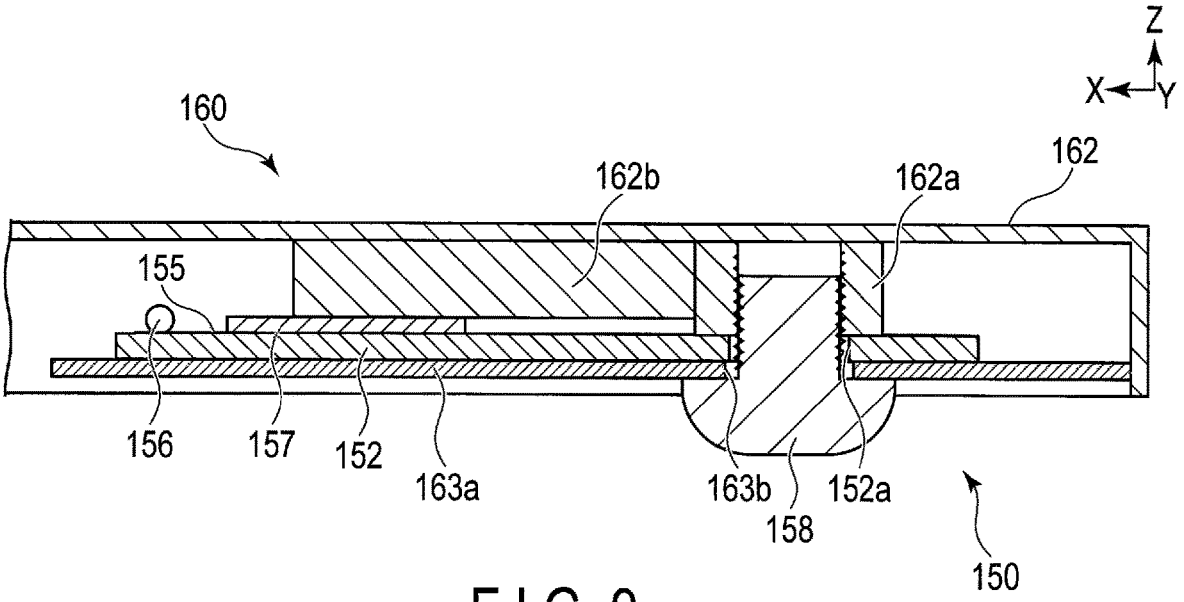
FIG. 9 is a side view showing the structural elements of FIG. 8.
Figure 11:
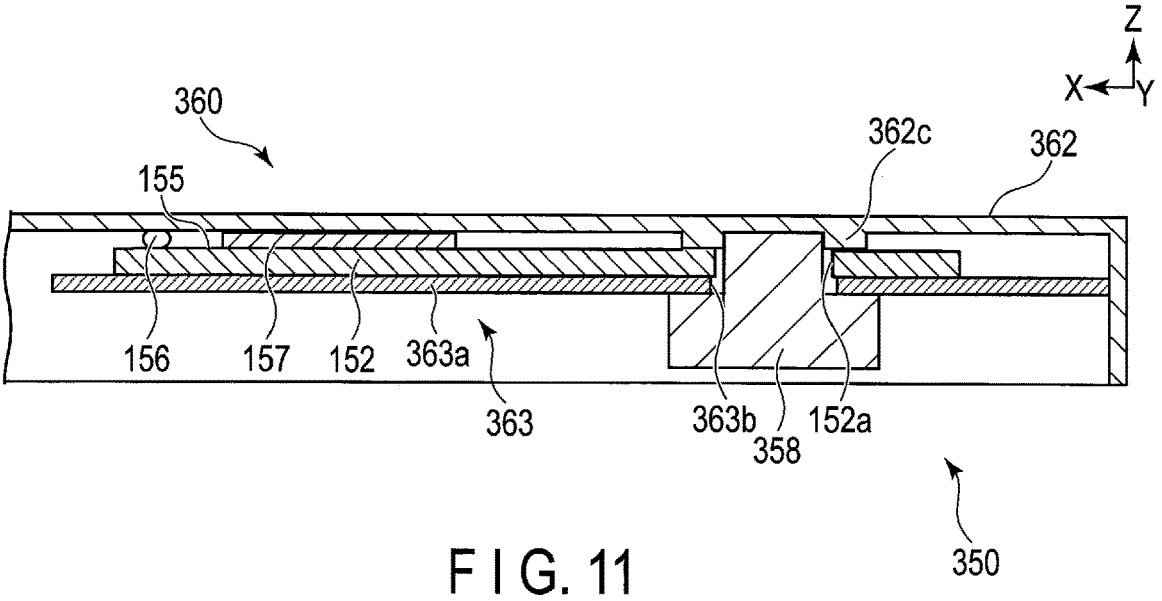
FIG. 11 is a perspective view showing the principal parts of the notebook computer of a modified example 2 of the embodiment.

Here, according to the modified example 2 of the embodiment, the gasket 157 also can be electrically connected to the antenna ground 155 and the top cover 362 in the state of being in close contact with the antenna ground 155 and the top cover 362 as shown in FIG. 11. Here, in the embodiment (not the modified example 2), as shown in FIG. 9, the rib 162*b* provided on the top cover 162 constitutes the first base portion to be brought into contact with the gasket 157, and the screw boss 162*a* constitutes the second base portion. On the other hand, as shown in the modified example 2 of the embodiment, it is also possible that the top cover 362 constitutes the first base portion to be brought into contact with the gasket 157, and the pin boss 362*c* constitutes the second base portion.

According to the embodiment, as shown in FIG. 9, the screw boss 162*a* projects from a surface of the top cover 162, closer to a surface of the antenna ground 155 than the rib 162*b* in the height direction. By virtue of this structure, the gasket 157 can be disposed so as to face the rib 162*b* in a state where there is a step between the screw boss 162*a* and the rib 162*b* (a difference in height due to a difference in thickness along the height direction Z). As a result, the antenna ground 155 and the screw boss 162*a* can easily be brought into contact with each other and be fixed in a state where the gasket 157 is interposed between the antenna ground 155 and the rib 162*b*.

According to the embodiment, the first antenna cover 163 supports the first antenna board 152, and is attached to the top cover 162. By virtue of this structure, it is possible to sufficiently maintain the rigidity of the first antenna board 152, and to prevent a member which may cause a communication failure from approaching or contacting the first antenna board 152. In particular, this structure is suitable for the case where the first antenna board 152 is easily deformed as in the case of a flexible printed circuit.

Figure 10:
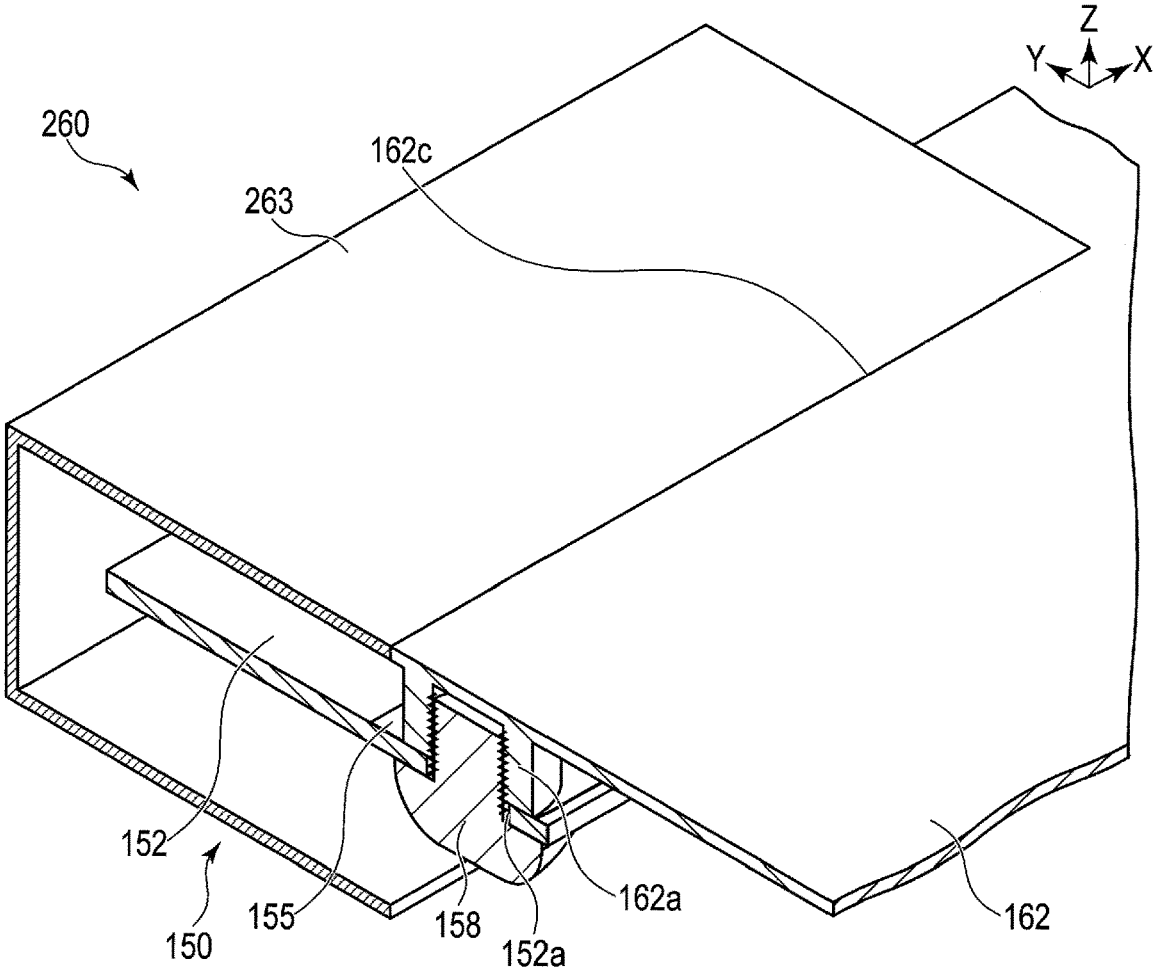
FIG. 10 is a perspective view showing the principal parts of the notebook computer of a modified example 1 of the embodiment.

Here, according to the modified example 1 of the embodiment, if the first antenna board 152 has sufficient rigidity and is not easily deformed, it is also possible that the first antenna cover 263 does not support the first antenna board 152 as shown in FIG. 10.

According to the embodiment, the resonant frequency of the antenna element 154 is greater than or equal to 2.4 GHz. By virtue of this structure, it is possible to reduce the width of the antenna element 154 in the width direction X and to increase the distance between the first hinge 166 and the second hinge 167 in the width direction X. The resonant frequency of the antenna element 154 and the width of the antenna element 154 in the width direction X are substantially in inverse proportion to each other. Thus, members constituting the notebook computer 100 can be sufficiently provided between the first hinge 166 and the second hinge 167. On the other hand, if the resonant frequency of the antenna element 154 is increased, the distance between the portion where the external conductor 156*b* of the coaxial cable 156 is joined to the antenna ground 155 by soldering and the screw insertion hole 155*a* of the antenna ground 155, which is electrically connected to the top cover 162 by the screw 158, easily has a bad influence. However, by virtue of the above-described structure, fluctuations in antenna performance due to a deviation in the laying of the coaxial cable 156 can be sufficiently suppressed.

According to the embodiment, in the antenna ground 155, the distance from the portion where the coaxial cable 156 is connected to the antenna ground 155 (the portion where the external conductor 156*b* is joined by soldering) to the gasket 157 is shorter than the distance from the portion where the coaxial cable 156 is connected to the antenna ground 155 (the portion where the external conductor 156*b* is joined by soldering) to the screw insertion hole 155*a*. By virtue of this structure, in the vicinity of the portion where the external conductor 156*b* of the coaxial cable 156 is joined by soldering, the antenna ground 155 is connected to the top cover 162 by using the gasket 157, and the top cover 162 can function as an antenna ground (antenna GND). Fluctuations in the antenna properties caused by the coaxial cable 156 can be sufficiently suppressed by the antenna ground 155 and the gasket 157 connected to the rib 162*b*. In particular, fluctuations in the communication state made with changes in the mounting of the coaxial cable 156 can be sufficiently suppressed.

The present invention is not limited to the above-described embodiments, and structural elements can be modified and embodied without departing from the scope of the invention when the invention is put into practice. Moreover, various inventions can be made by combining a plurality of structural elements disclosed the above-described embodiments as appropriate. For example, several structural elements may be deleted from all structural elements disclosed in the embodiments. Furthermore, structural elements in different embodiments may be combined as appropriate.

The housing comprising the first base portion and the second base portion has been described as the top covers 162 and 362, but may be the bottom cover 161.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic apparatus comprising:

a housing comprising a first base portion and a second base portion which are conductive respectively, wherein the first base portion and the second base portion are disposed in contact with each other, the second base portion includes a cylindrical portion projecting to a backside of the housing, a screw hole is formed at an inside of the cylindrical portion, and the first base portion has a rectangular portion projecting to the backside of the housing;

an antenna element;

an antenna ground to which the antenna element is connected;

an antenna board on which at least the antenna ground is formed;

a gasket which is located between the first base portion and the antenna ground in a height direction of the housing, and which is conductive; and a fixing member which fixes the second base portion and the antenna ground so that the second base portion is in contact with the antenna ground, and the second base portion and the antenna ground are electrically connectable to each other in a state where the gasket is in contact with the first base portion and the antenna ground.

2. The electronic apparatus of claim 1, wherein the second base portion projects from a surface of the housing, closer to a surface of the antenna ground than the first base portion in the height direction.

3. The electronic apparatus of claim 1, further comprising:

a cover which is made of a material able to transmit radio waves, and which covers the antenna board, wherein the cover supports the antenna board and is attached to the housing.

4. The electronic apparatus of claim 1, wherein a resonant frequency of the antenna element is greater than or equal to 2.4 GHz.

5. The electronic apparatus of claim 1, wherein an insertion hole, into which the fixing member is inserted, is formed on the antenna ground, and on the antenna ground, a distance between a portion where a communication cable is connected to the antenna ground and the gasket is shorter than a distance between the portion and the insertion hole.

6. The electronic apparatus of claim 1, wherein the second base portion is directly connected to the antenna ground.

7. The electronic apparatus of claim 1, wherein the first base portion and the second base portion face the antenna ground, and the second base portion is screwed to the antenna ground directly by the fixing member using the screw hole.

* * * * *